US009404229B2

(12) United States Patent
Wachsmann

(10) Patent No.: US 9,404,229 B2
(45) Date of Patent: Aug. 2, 2016

(54) COMPOSITE TOOL FOR A MILLING DRUM, MILLING TOOL HOLDER AND MILLING DRUM

(71) Applicant: BOMAG GmbH, Boppard (DE)

(72) Inventor: Steffen Wachsmann, Koblenz (DE)

(73) Assignee: BOMAG GmbH, Boppard (DE)

( * ) Notice: Subject to any disclaimer, the term of this patent is extended or adjusted under 35 U.S.C. 154(b) by 0 days.

(21) Appl. No.: 14/282,643

(22) Filed: May 20, 2014

(65) Prior Publication Data

US 2014/0346841 A1 Nov. 27, 2014

(30) Foreign Application Priority Data

May 21, 2013 (DE) ..... 10 2013 008 618

(51) Int. Cl.

| | |
|---|---|
| ***E01C 23/088*** | (2006.01) |
| ***E01C 23/12*** | (2006.01) |
| ***B28D 1/18*** | (2006.01) |
| *E21C 35/18* | (2006.01) |

(52) U.S. Cl.

CPC ..... *E01C 23/088* (2013.01); *B28D 1/188* (2013.01); *E01C 23/127* (2013.01); *E21C 2035/1826* (2013.01)

(58) Field of Classification Search

CPC ..... E21C 2035/1826; E01C 23/127; E01C 23/088; B28D 1/188

USPC ..... 299/87.1

See application file for complete search history.

(56) References Cited

U.S. PATENT DOCUMENTS

| | | | | |
|---|---|---|---|---|
| 6,779,850 | B1 * | 8/2004 | Schibeci et al. | 299/87.1 |
| 2004/0051369 | A1 * | 3/2004 | Luciano | 299/87.1 |
| 2006/0022510 | A1 * | 2/2006 | Sansone et al. | 299/95 |
| 2007/0132304 | A1 * | 6/2007 | Holl et al. | 299/39.8 |
| 2008/0164749 | A1 * | 7/2008 | Beach et al. | 299/106 |
| 2014/0035345 | A1 * | 2/2014 | Fundakowski et al. | 299/79.1 |

FOREIGN PATENT DOCUMENTS

WO 2008076690 A1 6/2008

OTHER PUBLICATIONS

German Patent Office, Search Report, Application No. 10 2013 008 618.3, mailed Nov. 7, 2013 (5 pages).

* cited by examiner

*Primary Examiner* — John Kreck
*Assistant Examiner* — Michael Goodwin
(74) *Attorney, Agent, or Firm* — Wood, Herron & Evans, LLP

(57) ABSTRACT

The present invention relates to a composite tool comprising at least two milling tool holders, to a milling tool holder for such a composite tool and to a milling drum equipped with such milling tool holders. According to the present invention, a milling tool holder is utilized for supporting a tool replacement device during tool replacement of the milling tool in the milling tool holder that precedes it in the peripheral direction. To this end, according to the present invention, a supporting area is provided on the base element of the milling tool holder, which supporting area provides appropriate stabilized guidance for the tool replacement device.

14 Claims, 4 Drawing Sheets

COMPOSITE TOOL FOR A MILLING DRUM, MILLING TOOL HOLDER AND MILLING DRUM

CROSS-REFERENCE TO RELATED APPLICATIONS

The present application claims priority under 35 U.S.C. §119 of German Patent Application No. 10 2013 008 618 3, filed May 21, 2013, the disclosure of which is hereby incorporated herein by reference in its entirety.

FIELD OF THE INVENTION

The present invention relates to a composite tool for a milling drum, to a milling tool holder for a composite tool and to a milling drum equipped with such a composite tool.

BACKGROUND OF THE INVENTION

In particular, milling tools are used on so-called ground milling machines, more particularly, road milling machines, recyclers, and stabilizers which have suitable milling tool holders distributed over the external cylindrical surface of a supporting barrel and held in place thereon. This overall unit is usually referred to as the "milling drum" and in such ground milling machines is usually driven on the chassis and is mounted for rotation about a horizontal axis extending transversely to the direction of travel and under working conditions cuts into the ground. The ground material is milled to the desired milling depth. Typically, the milling tools are designed, for example, as round shank chisels in known manner. The milling tools are each held by a milling tool holder that forms the link between the milling tool and the supporting barrel. Such generic milling tool holders comprise a base plate having a bottom surface for attachment to the supporting barrel of the milling drum and a top surface opposite to the bottom surface. The base plate is, thus, that part which in the installed state faces the supporting barrel and, in particular, is connected directly to the cylindrical exterior surface of the supporting barrel, for example, by a welded and/or bolted joint. The bottom surface of the base plate, as regarded in the radial direction of the supporting barrel, is opposite to the upper surface of the base plate, which, thus, describes that surface of the base plate that forms the outer surface of the base plate in the installed state. Furthermore, there is present a holding element that protrudes from the upper surface of the base plate and serves to accommodate the milling tool. For this purpose, there is present in the holding member a receiving channel for the milling tool, which channel extends from its forward side to its rearward side, as regarded in the direction of rotation of the milling tool. More specifically, the receiving channel accommodates, for example, the shank of a round shank chisel. "Direction of rotation" in this context refers to the direction of movement of the milling drum, or the milling tool holder in its installed state on the supporting barrel, in the operational mode. The direction of rotation is naturally oriented toward the working tip of the milling tool. The receiving channel is an ideally linear through bore in the holding member, which can be additionally equipped, for example, with rinsing ports and/or other features.

In order to facilitate smooth working operation of the rotating milling drum, usually a plurality of milling tools or milling tool holders are disposed on the supporting barrel. The unit, or tool assembly, consisting of at least two milling tool holders disposed in the peripheral direction one behind the other is hereinafter referred to as a "composite tool" or "composite tool holder" respectively. Alternatively, the "composite tool" could be designated as "tool group" or "tool unit" that includes at least two milling tools and milling tool holders, respectively. The milling tool holders are disposed in the peripheral direction one behind the other and with an offset in the axial direction of the axis of rotation of the milling drum, in order to make milling possible over the entire axial length, i.e., the width, of the milling drum. To this end, the milling tools are frequently disposed on the peripheral surface of the supporting barrel in the form of helices, which extend, depending on the embodiment, for example, in each case toward the center to cause the milled material to be transported in this direction so as to facilitate the removal of the milled material, for example, from a milling drum box. Appropriate arrangements are also known in the prior art. The present invention thus, more particularly, also relates to a composite tool for a milling drum having at least one forward milling tool holder, as regarded in the direction of rotation of the milling drum and at least one rearward milling tool holder, as regarded in the peripheral direction of the milling drum, disposed directly behind said forward milling tool holder with an offset therefrom in the axial direction of the axis of rotation of the milling drum, each of the milling tool holders being adapted to accommodate a milling tool, more particularly, a round shank chisel. At least two of the milling tool holders of the composite tool according to the present invention are thus disposed, as regarded in the peripheral direction of the milling drum, in direct succession and, more particularly, flush with one another and, very particularly, positively connected, at least partially, to each other, such that the ground milling action of the at least two milling tools is carried out first by the milling tool in the forward milling tool holder and then, slightly offset in the axial direction of the axis of rotation, by the milling tool in the rearward milling tool holder.

The number and density of the milling tools disposed on the supporting barrel bearing the milling tools, that is to say, the milling tool holders, can vary greatly depending on the application. In particular, in the case of so-called micro fine milling, which is not primarily concerned with a deep and large-volume extraction of material, but rather with increasing or restoring the skid resistance and/or flatness of a road surface, there is frequently a particularly dense arrangement of milling tools on the supporting barrel of the milling drum. In micro fine milling, often only a few millimeters of the top layer are removed, in particular, for the repair of roads, where a surface roughness of only a few millimeters is tolerated. The individual milling tools are thus disposed in line spaced at intervals of usually up to 6 millimeters on the supporting barrel. The linear distance between two milling tools corresponds to the distance of the cutting circles of the two tools, as regarded in the axial direction of the axis of rotation of the milling drum. This does not necessarily have to apply to two milling tools disposed directly one behind the other, as regarded in the direction of rotation.

When in operation, milling tools are naturally exposed to considerable wear effects, so that frequent replacement of the milling tools is required. Especially, in the case of milling drums used for micro fine milling, is this procedure, however, extremely complicated, particularly because of the dense arrangement of the milling tools. The space available is very narrow and complicates the exchange of individual milling tools, especially when the chisel has to be removed from the rear of the receiving channel toward the front, for example, by means of a chisel extractor. Accordingly, in such situations involving conventional milling drums, crushing of the operator's hands or other injuries will often occur. Or access to the rear is blocked and the round shank chisels must be pulled out or knocked out via the chisel head.

The object of the present invention is to provide a composite tool, a milling tool holder and a milling drum that are particularly suitable for micro fine milling involving narrow linear spacing of the milling cutters, making possible improved replacement of the milling tools over the prior art.

SUMMARY OF THE INVENTION

According to one embodiment of the present invention is that for the purpose of supporting a milling tool replacement device a supporting area is provided directly on the milling tool holder which provides a supporting area for tool replacement of the milling tool disposed in front thereof, as regarded in the direction of rotation, and at the same time is a suitable device for stabilized guidance of the milling tool replacement device or the milling tool replacement tool when carrying out the replacement. More specifically, according to the present invention, therefore, at least the rear tool holder of the composite tool of the present invention has on the base plate a supporting area comprising the stabilized guidance device, which makes it possible to support a milling tool replacement device adapted to knock the milling tool out of the front milling tool holder while at the same time providing stabilized guidance of the replacement tool. Thus, for the purposes of supporting and guiding the replacement tool, a supporting surface on a milling tool holder is used for carrying out this replacement procedure, which milling tool holder's milling tool is not currently being replaced. Instead, the milling tool replacement is carried out on the milling tool holder located in front thereof, as regarded in the peripheral direction. Accordingly, in the replacement procedure according to the present invention there are involved two milling tool holders. The forward milling tool holder, on which the tool replacement is carried out, and the rearward milling tool holder, which serves to support and, as will be further explained below, to guide a replacement tool, more particularly an ejector chisel, thus act for the purposes of milling tool replacement as a complementary functional whole. This supporting area is further disposed adjacent to the holder member of the milling tool holder, as regarded in the direction of advance of the tool. It is therefore expressly not positioned, as regarded in the direction of rotation, in front of or behind the milling tool. In the installed state of the milling tool holder on the supporting barrel, the holding member and the supporting area thus lie side by side, as regarded in the axial direction of the axis of rotation of the milling drum. A further characteristic feature is the fact that the supporting area opens out to the forward milling tool holder to allow a tool to be guided from the supporting area of the rearward milling tool holder toward the rear opening of the receiving channel of the forward milling tool holder. This means that the supporting area is not delimited, for example, by a wall element or the like in the direction of the forward milling tool holder, but rather extends as an open entity in the direction of the forward milling tool holder. This enables unhindered guidance of the milling tool replacement device from the rearward milling tool holder toward the forward milling tool holder. With this design of the composite tool according to the present invention, the space available for tool replacement is greatly increased, since the operator is not limited to inserting the milling tool replacement device into a single milling tool holder. Instead, he or she can resort to supporting the milling tool replacement device on the milling tool holder disposed behind it, as regarded in the peripheral direction, so that, in all, in terms of comfort and of bruises and injuries to the hand, the risk is reduced in the replacement procedure when guiding the milling tool replacement device, more particularly, an ejector chisel, and knocking out the milling tool.

The supporting area is generally dimensioned such that it provides a sufficiently large resting surface for the milling tool replacement device during the replacement procedure. Preferably, the supporting area is formed so as to extend longitudinally toward the opening of the receiving channel of the forward milling tool holder. This means that, when the milling tool holder is installed, the supporting area is larger in the peripheral direction of the milling drum than in the axial direction of the axis of rotation of the milling drum, that is to say, transversely to the direction of rotation. In other words, the supporting area is elongated in the direction of rotation, for example, extending over the entire length of the milling tool holder in the direction of rotation of the milling drum, and simultaneously, as regarded in its transverse direction, it is relatively narrow in the axial direction of the axis of rotation. In this way, on the one hand a supporting area is given which provides a sufficiently large resting surface toward the forward milling tool holder. On the other hand, due to the relatively narrow shape of the supporting area in the axial direction, a relatively narrow overall shape of the milling tool holder is obtained such that, for example, a comparatively dense side-by-side arrangement of the milling tool holders in the axial direction is possible, which is particularly desirable in micro fine milling.

The supporting area substantially serves as a lever support for a tool replacement device. More particularly, this may be an ejector chisel of the kind known in the art. Such an ejector chisel has a curved end portion which is introduced into the receiving channel for the milling tool in the holding member for the purpose of ejecting the chisel from the rear by means of its tip. Provision is now made for the ejector chisel to rest on the supporting area in the region of the bend and to be supported thereby. In this way, the opposite end of the chisel, which, for example, will be exposed to hammer blows, protrudes diagonally to the rear away from the milling drum, so that the operator will have sufficient space for applying the hammer blows. To prevent slippage of the milling tool replacement device resting on the supporting area, especially in the axial direction of the milling drum, the supporting area according to the present invention has a device for stabilized guidance of the milling tool replacement device. This device is characterized by the fact that it is designed such that it comprises a means of preventing or at least hindering transverse slippage of the milling tool replacement device during replacement, that is, slippage transversely to the radial direction of the axis of rotation of the milling drum, and particularly in the axial direction of the milling drum. In principle, a range of different devices may be used such as movement barriers, including stop ridges, delimiting barriers, etc. Taking into account the fact that in particular also the supporting area in operational mode is subjected to significant material load caused, for example, by milled material sliding past, the design of the supporting area in the form of a support trough has proven to be particularly preferable. In this embodiment, the supporting area is thus indented, or concave, toward the underside of the base part. Indentation, or concavity, is generally present when the surface is depressed in relation to the areas adjacent to the depressed areas or is recessed in the installed state of the milling tool toward the milling drum. This support concavity is characterized in particular by the fact that it may have a particularly robust and possibly solid construction, which dispenses with additional filigree devices for stabilized guidance of the milling tool replacement device. Moreover, such indentations are easy to produce technically, for example, during forging of the milling tool holder, etc.

The indentation can, in principle, be shaped as a shell having, for example, a peripheral edge. It is ideal, however, when the concavity extends generally linearly, especially with its longitudinal axis directed toward the forward milling tool holder. To this end, the supporting area is designed, for example, so as to have the shape of an elliptical cavity and, very particularly, the shape of a guide trough. A guide trough is generally characterized by the fact that it has a longitudinally extending indentation along a longitudinal axis and has, transversely thereto, an essentially V-shaped or U-shaped profile over its entire length. The term "profile" refers to the surface profile of the guide trough, as regarded in cross-section transverse to its longitudinal extension, which in the mounted state essentially corresponds to a cross section taken in the radial direction and along the longitudinal axis of the milling drum. In addition to having a start and an end, the trough is distinguished, in particular, by a base line, indicating the course of the lowest points of the guiding trough along its length, as well as two lateral edges, one on each side of the trough. Ideally, provision is made, according to the present invention, for the longitudinal axis of the guide trough, i.e., the axis formed, for example, by the edge profile and/or the course of the trough's base line, to be oriented in its longitudinal direction so as to extend substantially in the peripheral direction. In other words, the guide trough is aligned with the rearward milling tool holder in such a manner in its base part that it extends toward the forward milling tool, as is the case, in particular, with the two edges of the trough. The trough walls, i.e., that portion of the trough that is disposed between the rim and the base line thereof, prevent movement of the milling tool replacement device transversely to the direction of rotation, that is to say, in the axial direction of the milling drum so that slippage of the milling tool replacement device is prevented or at least hindered to a significant extent. The profile of the guide trough is also preferably adapted to the shape of the milling tool replacement device in such a way that, on the one hand, there is sufficient room for the milling tool replacement device and, on the other hand, a sufficiently high degree of stabilized guidance of the milling tool replacement device is provided by the guiding trough.

It is basically important that the supporting area provides a sufficient and safe supporting surface for the milling tool replacement device. To this end, the supporting area and, in particular, the means for achieving stabilized guidance in the axial direction is preferably flush with the front edge of the base part at its forward end, that is to say, it extends up to said forward edge. Additionally, or alternatively, the supporting area of the rearward milling tool holder and, in particular, the means for providing stabilized guidance are also designed in such a manner that, as regarded in the axial direction, they are flush with the edge of the base of the forward milling tool holder, as regarded in the direction of rotation. The end of the supporting area to the side thereof, that is to say, in the axial direction of the milling drum, is thus preferably also at the same time the end of the milling tool holder, as regarded in the peripheral direction. In this way, a relatively narrow configuration of the milling tool holder and a dense overall arrangement are made possible.

Preferably, the supporting area and in particular the guide trough are formed so as to slope downwardly in a forward direction, as regarded in the peripheral direction. This means that the forward end of the supporting area, as regarded in the peripheral direction, is preferably at a shorter radial distance from the cylindrical surface of the supporting barrel than its rearward end. As seen from the rearward milling tool holder, the supporting area thus has a downward slope in the direction of the forward milling tool holder. In this way, a guide is created for the milling tool replacement device in the direction of the forward milling tool holder, so that tool replacement is effected more reliably and more safely.

The base part and the holding member can basically either comprise two individual components or be formed as one solid piece. Both variants are provided for by the present invention. In this context it should further be noted that on the holding member, of course, a means may be provided in the form of an exchange holder which can take the form of another replaceable unit, known per se, disposed between a base of the holding member and the milling tool. The base part may comprise an at least approximately cuboid basic body, which preferably has, in addition, a convex holding means projecting radially outwardly from the basic body, which holding means serves to accommodate and mount the holding member. The holding member is more particularly in the form of a substantially cylindrical element having a central receiving channel. The axis of the cylinder in this case extends downwardly sloping from front to back in the direction of the supporting barrel so that the inserted milling tool extends obliquely forward in the peripheral direction of the milling drum. Preferably, the supporting area and especially the means for providing stabilized guidance are now shaped in such a way that they abut the convex holding element on the base part in the axial direction, that is to say transversely to the forward milling tool, that is to say they form the side wall of the convex holding element and at the same time form the lateral boundaries of the supporting area and, in particular, of the guide trough. The supporting area and, in particular, the means for providing stabilized guidance thus preferably extend alongside this convex holding element, which also creates a particularly efficient use of space.

As described above, the milling tool holders often take the form of coils, or helices, encircling the outer surface of the supporting barrel of the milling drum. In particular, in the case of milling drums suitable for micro fine milling processes, the standard widths can hold more than 1000 milling tool holders on a single supporting barrel. In this connection, it has been found to be preferable when the forward and rearward milling tool holders of the composite tool according to the present invention are identical in shape. This presupposes that each of the milling tool holders used is ideally shaped, as regarded in the peripheral direction, with its forward side complementary to its rearward side so as to provide a positive arrangement of, in particular, a plurality of milling tool holders disposed one behind the other, as regarded in the peripheral direction.

In another aspect, the present invention relates to a milling tool holder for a composite tool, as described above. For details on the construction of the milling tool holder and for information on preferred embodiments, reference is made to the above descriptions concerning the milling tool holders according to the present invention. In this case, a milling tool holder according to the present invention as per the above embodiments is designed, in particular, in such a way that it has a supporting area that is adapted to support the milling tool replacement device, which supporting area is in the form of a guide trough which is open toward the front of the milling tool and is ideally constructed so as to slope forwardly downwardly, as regarded in the peripheral direction. For further information on alternative arrangements and preferred embodiments of the milling tool holder, specific reference is made to the relevant descriptions above. The forward downward slope of the guide trough provides a particularly favorable leverage support for a chisel ejector pin, as is known per se. Such a configuration of the guide trough also takes into account the fact that the milling tool replacement device, when in use, is often mounted obliquely to the outer cylindrical surface of the milling drum so that in this way the curve of the bearing surface of the supporting area is adapted to the usual position of the milling tool replacement device.

Finally, according to another aspect, the present invention relates to a milling drum comprising a composite tool as has been described above. Each composite tool typically comprises a plurality of individual milling tool holders as disclosed above and herewith included by reference, while a milling drum may comprise a plurality of such composite tools, for example, in the form of single coils extending in opposite directions.

The milling drum according to the present invention makes it possible to achieve a very high density of milling tools or milling tool holders on the supporting barrel of the milling drum. The present invention thus relates, in particular, to a milling drum which has a configuration of milling tool holders showing line spacing of less than 8 mm, more particularly of less than 6 mm and, very particularly, of less than 4 mm. The distance between of the lines is measured in the axial direction, that is, in the direction of the axis of rotation of the milling drum.

BRIEF DESCRIPTION OF THE DRAWINGS

The present invention is described in more detail below with reference to the exemplary embodiment shown in the figures, in which.

Like components are indicated in the figures with like reference numbers, and not every component repeated in the figures is denoted in each figure.

DETAILED DESCRIPTION OF THE INVENTION

Figure 1:
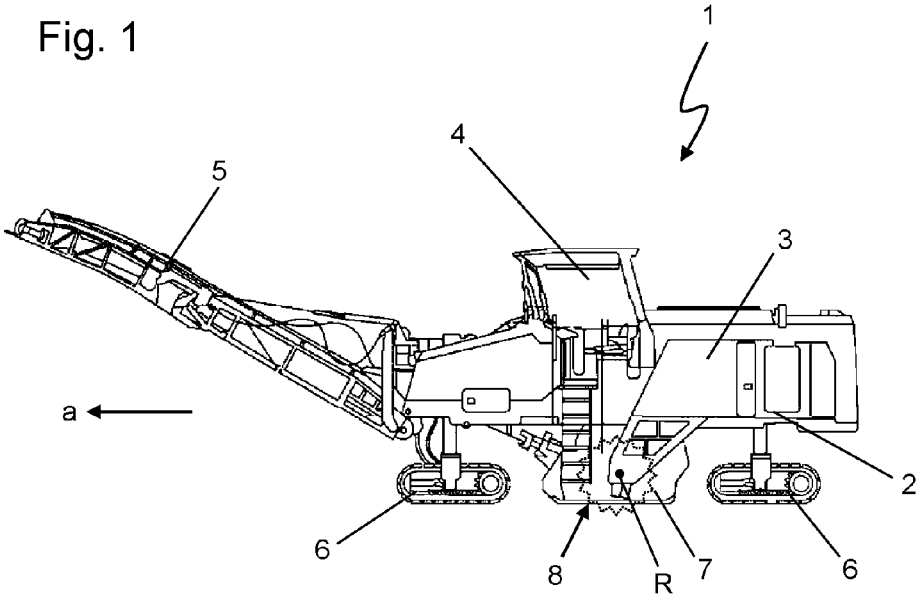
FIG. 1 is a side view of a road cold milling machine.

The road milling machine 1 shown in FIG. 1 is a ground milling machine of the type having a center rotary drum, the essential elements of which are, in addition to a chassis 2, an unspecified driving device 3, an operator's platform 4, a front loading conveyor belt 5, and also driving devices 6 in the form of chain drives (may also be wheel drives) and connected via lifting columns to the chassis 2, and, disposed in a milling drum box 7, a milling device in the form of a milling drum 8. The milling drum 8 is rotatable within the milling drum box 7 about a horizontal axis of rotation R extending transversally to the direction of advance a and in the operating mode cuts into the ground to mill ground material in a manner known per se.

Figure 2:
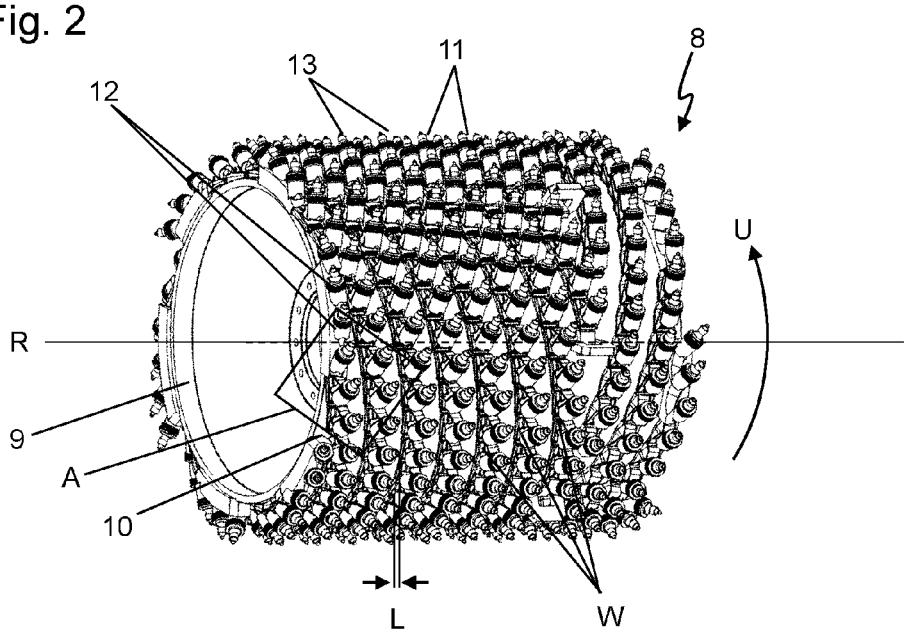
FIG. 2 is an oblique perspective view of a milling drum for micro fine milling.

A specific application of such a road milling machine 1 is the procedure known as micro fine milling. The operation of micro fine milling is characterized by the removal of only a few millimeters of the ground surface, while simultaneously a relatively flat surface is obtained. Characteristic of milling drums that are used for micro fine milling is a relatively high density of milling tools on the outer cylindrical surface of the milling drum. FIG. 2 shows additionally a milling drum 8 specially adapted for micro fine milling. Its key elements are a supporting barrel 9 having an outer peripheral surface 10 and a plurality of milling tool holders 12 equipped with milling tools 11 which are disposed on the outer peripheral surface 10 of the supporting barrel 9, the specific structure of which is shown in more detail in the following figures. The milling tools 11 are in this specific exemplary embodiment so-called round shank chisels. The supporting barrel 9 is a substantially hollow cylindrical main body containing in its interior attachment means and/or drive means, such as a connecting flange and/or transmission elements for connection to the road milling machine 1 and for transmission of the driving power therefrom. On the outer peripheral surface 10, the milling tool holders 12 are disposed in the form of W-shaped coils, and in the exemplary embodiment shown in FIG. 2 coils from the left side and from the right side of the supporting barrel meet. FIG. 2 also shows that the density of the milling tool holders 12 and thus of the available milling tools 11 with respect to the outer peripheral surface is relatively high, leaving little free space on the outer cylindrical surface 10, since the individual milling tools 11 are aligned to each other with a relatively narrow linear spacing L of 6 mm. The linear spacing L is determined by the distance between two adjacent milling circles of the tips 13 of the milling tools 11 along the axis of rotation R during rotational movement of the milling drum 8 in the peripheral direction U. For reasons of clarity, the spacing L of two milling tools successively aligned in the peripheral direction is exemplified in FIG. 2, although the chisels are actually disposed in a staggered relationship, such that the minimum spacing between two tools is even smaller than the linear spacing L of the two milling tools as shown in FIG. 2.

Figure 3:
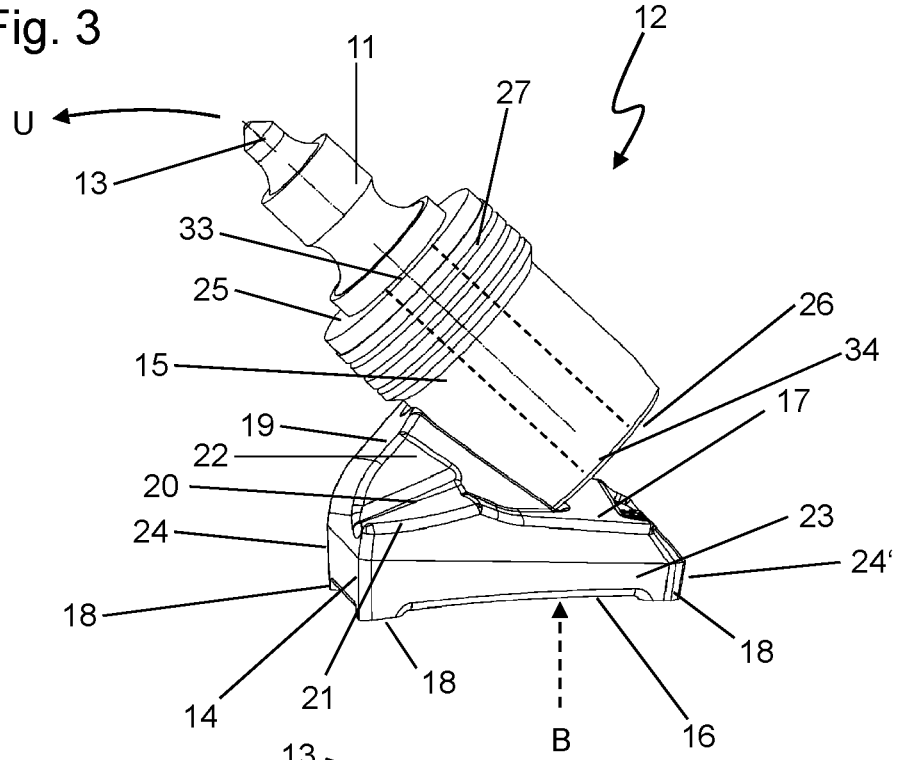
FIG. 3 is a perspective side view of a milling tool holder equipped with a cutting tool.
Figure 4:
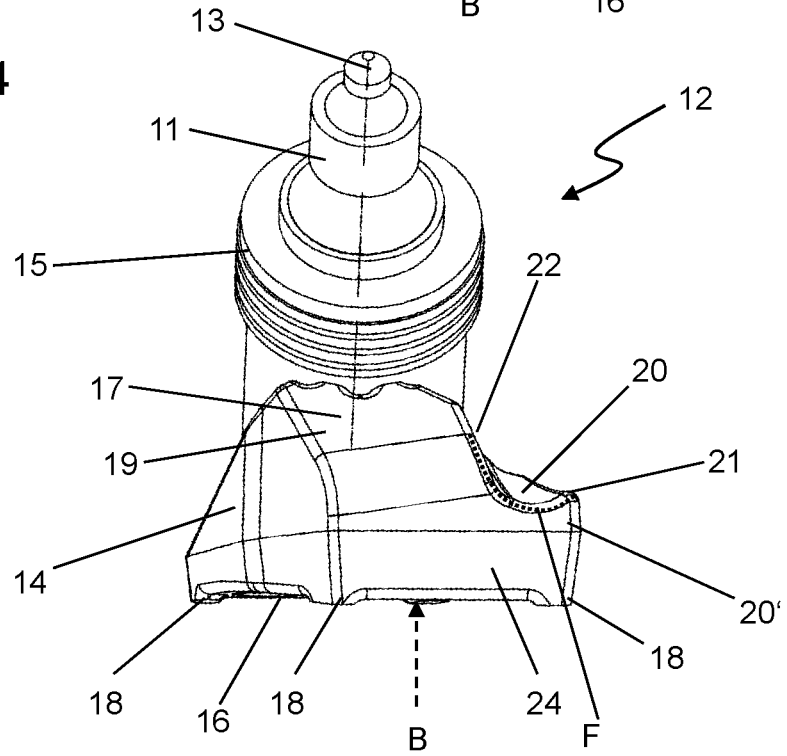
FIG. 4 is a front perspective view of the milling tool shown in FIG. 3.

FIGS. 3 and 4 illustrate the basic structure of the milling tool holder 12, each of which is equipped in the present exemplary embodiment with a milling tool 11 in the form of a round shank chisel having a tool tip 13. Essential elements of the milling tool holder 12 are a base element 14 and a holding member 15. The base element has a bottom surface 16 and a top surface 17. When installed, the bottom surface 16 of the milling tool holder 12 faces the outer peripheral surface 10 of the supporting barrel 9 and, in the specific exemplary embodiment, rests with its supporting feet 18 on the outer surface 10. Specifically, attachment to the supporting barrel 9 can be achieved, for example, via a welded joint. Opposed in the radial direction B (with reference to the installed condition on the supporting barrel 9) there is the top surface 17 of the base element, which thus constitutes the outer surface of the milling tool holder 12 in the installed state. On the top surface 17, the base element 14 is connected to the holding member 15 via a holding bulge 19, which projects from an approximately cuboid-shaped base 20 of the base element 14, as regarded in the radial direction B. This holding bulge 19 provides a supporting shoulder for the holding member 15 to allow the holding element 15 to obliquely project forward from the supporting barrel 9.

Another essential element of the base element 14 is a supporting area 20, which is disposed transversely to the peripheral direction U and, in the installed state of the milling tool holder 12 on the supporting barrel 9, is adjacent to the retaining bead 19 and thus to the holding member 15 on the base element 14. The supporting area 20 is specifically designed as a trough sloping forward and downwardly in the direction of rotation U and having edges 21 and 22 at its sides.

The edge or ledge 21 closes substantially flush with the side wall 23 of the base element 14, thus forming in this direction the end of the milling tool holder 12. The edge or ledge 22, on the other hand, is designed as extending upwardly on the side of retaining bead 19. In all, the supporting area 20 extends in the peripheral direction U from the front third of the longitudinal extension of the base element 14 to the front wall 24 of the base element 14, said wall extending upwardly in substantially the radial direction B, and hence opens out toward the front surface. This is clarified in FIG. 4, in which the U-shaped or trough-shaped profile 20', of the front end region of the supporting area 20 is traced with a dashed line. F denotes the base point of the indentation in the region of the front edge. The supporting area 20 between the edges 21 and 22 is arched downwardly or toward the bottom surface 16, starting from the top surface 17, whereby the trough-shaped guide channel is obtained as per the above statements. In all, this provides a device for stabilized guidance of the replacement tool in the supporting area, specifically on account of the special shape of the guide trough, which significantly improves the replacement procedure and, in particular, the handling and control of the replacement tool during replacement. Lateral slippage of the tool replacement device is, for example, almost impossible.

The holding member 15 is connected to the base element 14 in the present exemplary embodiment by means of weld joints, although releasable variants are possible within the scope of the present invention as is a solid construction of the whole, consisting of the base element 14 and holding member 15. The holding member 15 is substantially cylindrical and has a front side 25 located at the front, as regarded in the direction of rotation U, and a rear side 26 located at the rear, as regarded in the direction of rotation U. From the front side 25 toward the rear side 26, a receiving channel 27 extends through the holding member 15, as can be seen in the sectional view shown in FIG. 6. In FIG. 3, the receiving channel 27 having a front side opening 33 and a rear side opening 34 is shown diagrammatically. Specifically, the receiving channel 27 is a through-bore extending through the holding member and adapted to accommodate a chisel shank (or other fastening element) of the milling tool 11 coming from the front side 25.

In operation, considerable wear takes place especially on the milling tool 11 so that regular replacement of the milling tool 11 in the holding member 15 of the milling tool holder 12 is required. This proves to be difficult especially with milling drums adapted for micro fine milling, such as are illustrated, for example, in FIG. 2, particularly for space reasons, as the available space for the removal of the milling tool 11 from the holding member 15 is very limited due to the very close arrangement of the milling tool holders 12. The design of a milling tool holder according to the present invention is a significant improvement, as is illustrated in detail in FIGS. 5 to 7 in particular.

Figure 5:
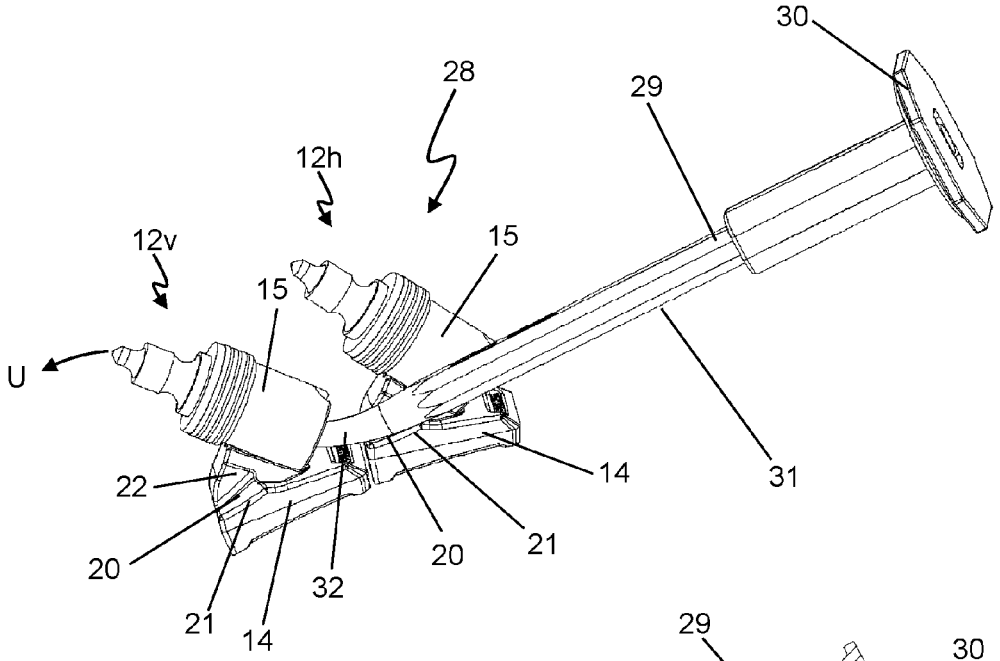
FIG. 5 is an oblique perspective view of a composite tool during a replacement procedure.
Figure 6:
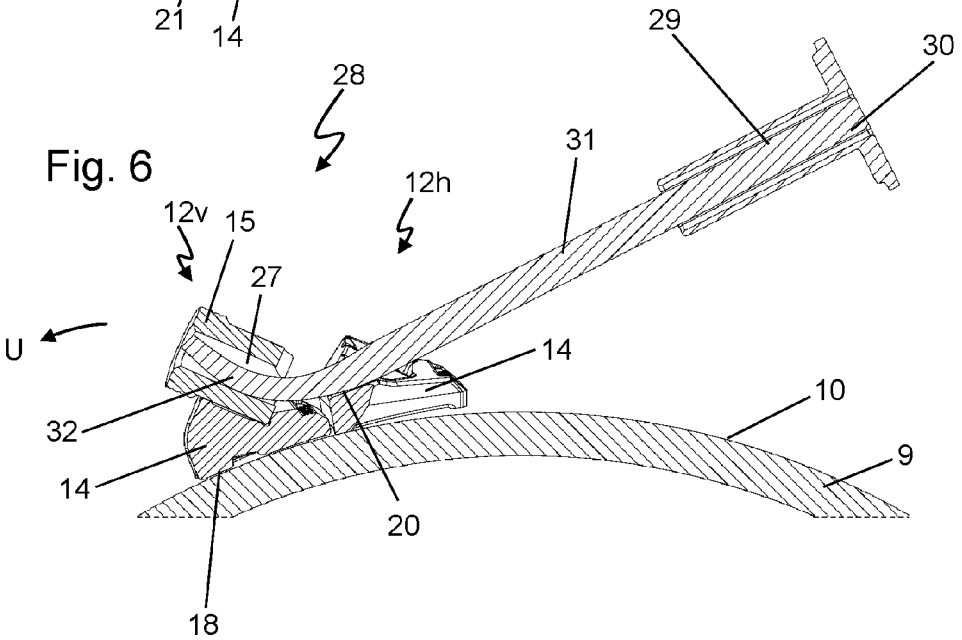
FIG. 6 is a sectional view of the composite tool shown in FIG. 3 with an ejected milling tool.
Figure 7:
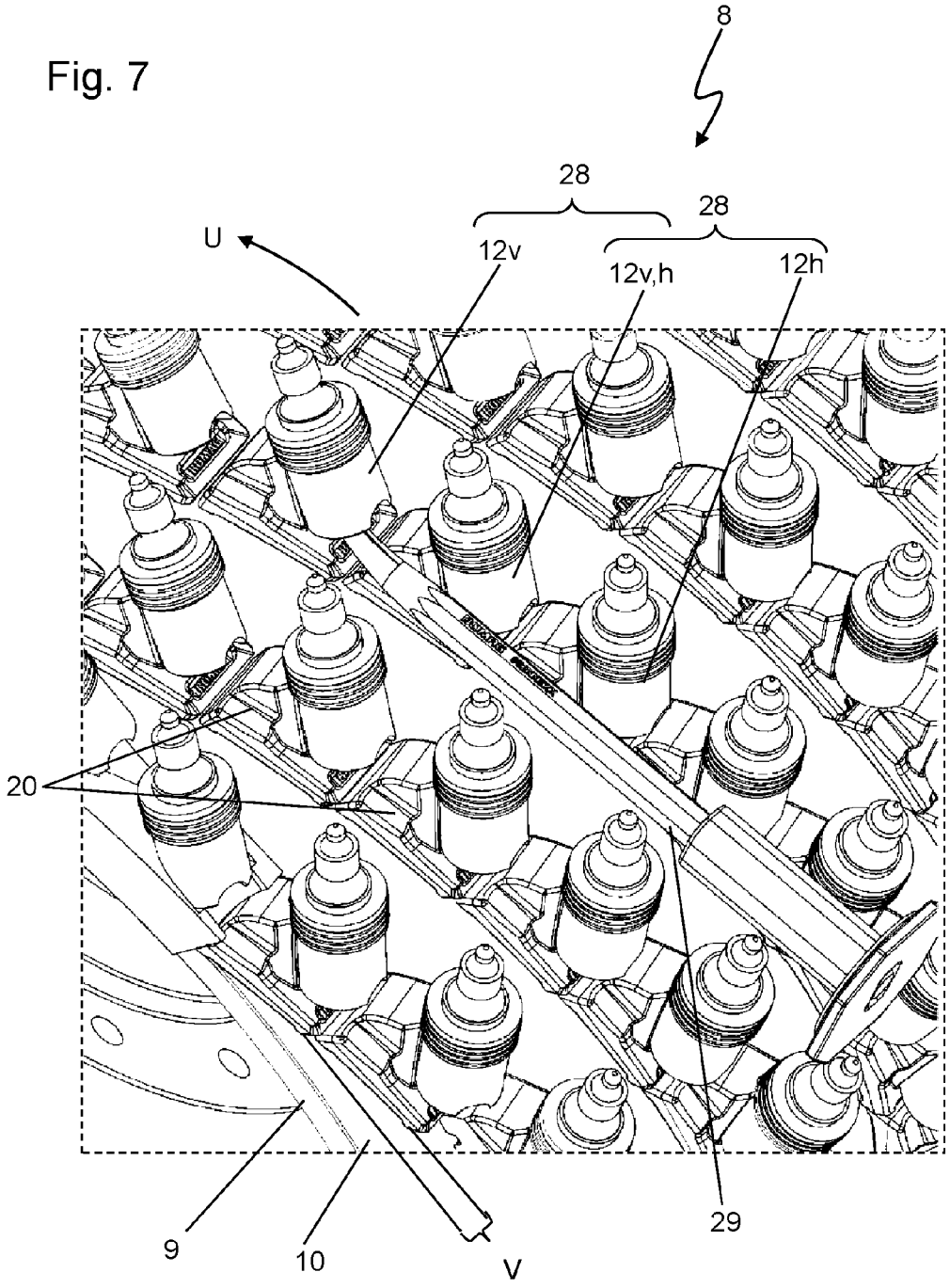
FIG. 7 is an oblique perspective view of an enlarged detailed view of area A of the milling drum shown in FIG. 2.

FIGS. 5 to 7 illustrate the use and mode of operation in particular of the supporting area 20 on the base element 14 during the replacement procedure and the beneficial effects of the device for stabilized guidance, specifically the guide trough. In FIGS. 5 and 6, there is a partial display of a composite tool 28 having at least one forward milling tool holder **12*v* and one rearward milling tool holder 12*h*, which are each, in accordance with the foregoing, designed as milling tool holders 12. The two identically constructed milling tool holders 12*v* and 12*h* of the composite tool 28 are set directly one behind the other, as regarded in the direction of rotation U, in such a manner that the rear milling tool holder 12*h* with its forward side 24 partially touches the rear face 24' (FIG. 3) of the preceding milling tool holder 12*v*. In this respect, the rearward milling tool holder 12*h* supports the forward milling tool holder 12*v*, as regarded in the direction of rotation. The terms "forward" and "rearward" refer, respectively, to a pair of milling tool holders 12 of a composite tool 28 for a particular replacement operation of the milling tool, although the composite tool 28 may comprise considerably more individual milling tool holders 12 in appropriate configuration. According to the present invention, tool replacement is always carried out on the forward milling tool holder 12*v* and support of the ejector chisel is always effected on the rearward milling tool holder 12, as described below in greater detail. It is important to note that functionally one and the same milling tool holder 12 can be used either as a forward milling tool holder or as a rearward milling tool holder, as indicated in FIG. 7, by way of example, on the milling tool holder designated by 12*v, h***.

The greatest challenge in connection with the replacement of the milling tool 11 is the removal of the worn milling tool 11 from the milling tool holder 12. This is done with an ejector chisel 29, which comprises a shank portion 31 in addition to a knock absorber 30, at the end of which there is a curved ejector pin 32. For the ejecting operation, an ejector chisel 29 is placed behind the milling tool holder **12*v* while resting on the supporting area 20 and the ejector pin 32 is inserted through the rear side opening 34 on the rear side 26 of the holding member 15 into the receiving channel 27 behind the milling tool 11. A driving force is generated on the milling tool 11 toward the forward surface 25 of the holding member 15 by hammer blows applied to the knock absorber 30. The supporting area 20 forms a kind of fulcrum for the ejector chisel 29. What is essential is that the milling tool holder 12*h* serves as a supporting element for a milling tool replacement on the milling tool holder 12*v*. In particular, FIG. 7 illustrates this optimized arrangement. It particularly also illustrates that sequentially a rearward milling tool holder 12*h* becomes a forward milling tool holder 12*v* for the purposes of a subsequent milling tool replacement procedure. The number of milling tool holders 12 per composite tool 28 can be increased almost indefinitely and depends mainly on the size of the supporting barrel 9 and the pitch of the individual coils of milling tool holders 12**.

It is essential for proper functioning of the present system that the supporting area allows unhindered access to the rear surface 26 of the holding member 15 to allow correct guidance of the ejector chisel 29 from the rear milling tool holder **12*h* to the rear side opening 34 on the rear side 26 of the forward milling tool 12*v*. This is achieved in this case in that the base area of the guide trough 20 extends up to the front edge of the base element 14. This creates a sliding surface through the guide trough 20 at the rear milling tool holder 12*h*, with the end of the sliding surface being open towards the forward milling tool holder 12*v*. The guide trough 20 is, furthermore, the device for achieving stabilized guidance, particularly on account of its trough-shaped profile. On the one hand, this creates mobility of the replacement tool toward the forward milling tool holder, while on the other hand, it is difficult or even impossible for it to move transversely beyond the flanks of the upstanding outside edges of the guide trough 20**. In this way, the operator can operate the replacement tool safely and easily.

FIG. 5 illustrates the commencement of the ejecting procedure and FIG. 6 shows the state after the chisel has been knocked out. Both figures show that both milling tool holders **12*v* and 12*h* act as a functional whole during the ejection of the chisel. In particular, FIG. 6 also shows that the front wall of the rearward milling tool holder 12*h* almost touches the rear wall of the forward milling tool holder 12***v*, as regarded in the direction of rotation. The two milling tool holders 12*v* and 12*h* are in staggered relationship to each other with an offset V in the axial direction of the axis of rotation R (FIG. 7), by means of which the supporting area 20 of the rear milling tool holder 12*h* is offset to face towards the rear side opening 34 on the rear side 26 of the receiving channel 27 of the forward milling tool holder 12*v*.

While the present invention has been illustrated by description of various embodiments and while those embodiments have been described in considerable detail, it is not the intention of Applicant to restrict or in any way limit the scope of the appended claims to such details. Additional advantages and modifications will readily appear to those skilled in the art. The present invention in its broader aspects is therefore not limited to the specific details and illustrative examples shown and described. Accordingly, departures may be made from such details without departing from the spirit or scope of Applicant's invention.

What is claimed is:

1. A composite tool for a milling drum comprising:

at least one forward milling tool holder, as regarded in the direction of rotation (U) of said milling drum, and at least one rearward milling tool holder disposed directly behind said forward milling tool holder, as regarded in the direction of rotation (U) of said milling drum, and offset therefrom in the axial direction of the axis of rotation (R) of the milling drum, wherein each of said milling tool holders is adapted to accommodate a milling tool, each of the milling tool holders comprising:

a base element having a bottom surface for attachment to a supporting barrel of a milling drum and a top surface disposed opposite to said bottom surface;

a holding member projecting upwardly from the top surface of the base element and comprising a continuous receiving channel for the accommodation of said milling tool, which receiving channel extends through said holding member from a front side opening on the forward side to a rear side opening on the rearward side, wherein at least on the base element of said rearward milling tool holder, as regarded in the direction of tool advance, there is provided, adjacent to said holding member, a supporting area for a milling tool replacement device, which supporting area opens out to said forward milling tool holder and comprises a device configured to provide stabilized guidance of said milling tool replacement device from the supporting area of said rearward milling tool holder toward the rear side opening of the receiving channel of said forward milling tool holder and to prevent movement of said milling tool replacement device in opposite axial directions relative to the supporting area.

2. The composite tool according to claim 1, wherein said supporting area has an elongated shape and is oriented in the direction toward the rear side opening of the receiving channel of said forward milling tool holder.

3. The composite tool according to claim 1, wherein said supporting area is indented in the direction toward the bottom surface of the base element.

4. The composite tool according to claim 1, wherein said supporting area is in the form of a guide trough.

5. The composite tool according to claim 4, wherein the longitudinal axis of said guide trough extends substantially in the direction of rotation (U).

6. The composite tool according to claim 1, wherein said supporting area ends, as regarded in the axial direction, flush with an edge of the said base element.

7. The composite tool according to claim 1, wherein said forward milling tool holder and said rearward milling tool holder are identically constructed.

8. A milling drum comprising a composite tool according to claim 1.

9. The milling drum according to claim 8, wherein said milling drum comprises a plurality of milling tool holders having line distances (L) of less than 8 mm measured in the axial direction.

10. The milling drum according to claim 9, wherein said milling drum comprises a plurality of milling tool holders having line distances (L) of less than 6 mm.

11. The milling drum according to claim 9, wherein said milling drum comprises a plurality of milling tool holders having line distances (L) of less than 4 mm.

12. The composite tool according to claim 1, wherein said milling tool comprises a round shank chisel.

13. A rearward milling tool holder for use with a forward milling tool holder, as regarded in the direction of rotation (U) of a milling drum to which the rearward and forward milling tool holders are mounted, the rearward milling tool holder being disposed directly behind the forward milling tool holder, as regarded in the direction of rotation (U) of the milling drum, and offset therefrom in the axial direction of the axis of rotation (R) of the milling drum, each of the forward and rearward milling tool holders being adapted to accommodate a respective milling tool, the rearward milling tool holder comprising:

a base element having a bottom surface for attachment to a supporting barrel of a milling drum and a top surface disposed opposite to said bottom surface;

a holding member projecting upwardly from the top surface of the base element and comprising a continuous receiving channel for the accommodation of said milling tool, which receiving channel extends through said holding member from a front side opening on the forward side to a rear side opening on the rearward side, wherein on the base element of said rearward milling tool holder, as regarded in the direction of tool advance, there is provided, adjacent to said holding member, a supporting area for a milling tool replacement device, which supporting area opens out to a front of said rearward milling tool holder and comprises a device configured to provide stabilized guidance of said milling tool replacement device from the supporting area of said rearward milling tool holder toward a rear side opening of a receiving channel of the forward milling tool holder and to prevent movement of said milling tool replacement device in opposite axial directions relative to the supporting area.

14. The rearward milling tool holder according to claim 13, wherein said supporting area is in the form of a guide trough, and further wherein said guide trough slopes forward in a downward direction, as regarded in the direction of rotation (U).

* * * * *